US005521609A

United States Patent [19]

Desch et al.

[11] Patent Number: 5,521,609

[45] Date of Patent: May 28, 1996

[54] MAGNETIC ANTENNA USING METALLIC GLASS

[75] Inventors: Michael D. Desch, Greenbelt; William M. Farrell, Kensington; Jeffrey G. Houser, Silver Spring, all of Md.

[73] Assignee: The United States of America as represented by the Administrator of the National Aeronautics and Space Administration, Washington, D.C.

[21] Appl. No.: 372,538

[22] Filed: Jan. 13, 1995

[51] Int. Cl.[6] ..... H01Q 7/08

[52] U.S. Cl. ..... 343/788; 343/787

[58] Field of Search ..... 343/785, 787, 343/788, 895

[56] References Cited

U.S. PATENT DOCUMENTS

| | | | |
|---|---|---|---|
| 4,148,036 | 4/1979 | Miller | 343/788 |
| 4,458,248 | 7/1984 | Lyasko | 343/719 |
| 4,658,263 | 4/1987 | Urbanski | 343/788 |
| 4,746,926 | 5/1988 | Stern et al. | 343/788 |
| 5,250,944 | 10/1993 | Urbas et al. | 343/788 |
| 5,396,698 | 3/1995 | Orthmann et al. | 29/600 |

*Primary Examiner*—Donald T. Hajec
*Assistant Examiner*—Tan Ho
*Attorney, Agent, or Firm*—Keith L. Dixon

[57] ABSTRACT

A lightweight search-coil antenna or sensor assembly for detecting magnetic fields and including a multi-turn electromagnetic induction coil wound on a spool type coil form through which is inserted an elongated coil loading member comprised of metallic glass material wrapped around a dielectric rod. The dielectric rod consists of a plastic or a wooden dowel having a length which is relatively larger than its thickness so as to provide a large length-to-diameter ratio. A tri-axial configuration includes a housing in which is located three substantially identical mutually orthogonal electromagnetic induction coil assemblies of the type described above wherein each of the assemblies include an electromagnetic coil wound on a dielectric spool with an elongated metallic glass coil loading member projecting therethrough.

17 Claims, 4 Drawing Sheets

MAGNETIC ANTENNA USING METALLIC GLASS

ORIGIN OF THE INVENTION

This invention was made by employees of the United States Government, and may be manufactured and used by or for the Government for governmental purposes without the payment of any royalties thereon or therefor.

BACKGROUND OF THE INVENTION

1. Field of the Invention

This invention relates generally to apparatus for sensing electromagnetic radiation and more particularly to a search-coil antenna for detecting magnetic fields.

2. Description of the Prior Art

A search-coil is a device that measures fluctuating magnetic fields and comprises a magnetic antenna and associated electronics therefor. When used on sounding rockets or on spacecraft, search-coils are typically mounted on a boom in order to escape the electronic noise generated by other scientific instruments and/or subsystems in the immediate vicinity.

As a general rule, scientific instrumentation should impact mass constraints as little as possible; however, boom-mounted instruments in particular must be lightweight to survive deployment under high stress conditions when used in connection with spacecraft. This weight constraint can limit both the size of the sensor and its placement on the boom. Both factors translate into severe constraints on the capability of the instrument to measure weak electromagnetic fields encountered, for example, in space.

For this type of task, the known prior art typically comprises relatively heavy ferrite-loaded loop type antennas shown and described, for example, in the section entitled "Loop Antennas" by G. S. Smith, which appears in *Antenna Engineering Handbook*, edited by R. C. Johnson et al, McGraw-Hill, Inc., New York, 1961.

SUMMARY

Accordingly, it is an object of the present invention to provide an improvement in search-coil type receiving antennas.

It is a further object of the present invention to provide a lightweight metallic glass antenna for detecting AC magnetic fields generated by natural and man made sources.

It is another object of the invention to provide a lightweight search-coil antenna for detecting AC magnetic fields in outer space.

It is yet another object of the invention to provide a metallic glass antenna having an improved effective height characteristic in the frequency range below and above 100 kHz.

The foregoing and other objects are realized by a lightweight search-coil antenna for detecting magnetic fields and including a multi-turn electromagnetic induction coil wound on a spool type coil form through which is inserted an elongated coil loading device comprised of metallic glass material wrapped around a dielectric rod. The dielectric rod is comprised of a plastic or a wooden dowel having a length which is relatively larger than its diameter so as to provide a large length-to-diameter ratio. Furthermore, a tri-axial search-coil antenna configuration exists and includes a housing in which is located three substantially identical mutually orthogonal electromagnetic induction coil assemblies of the type described above wherein each of the assemblies include an electromagnetic coil wound on a dielectric spool with an elongated metallic glass coil loading sub-assembly projecting therethrough.

BRIEF DESCRIPTION OF THE DRAWINGS

The following detailed description of the invention will be more readily understood when considered together with the accompanying drawings, wherein.

DETAILED DESCRIPTION OF THE PREFERRED EMBODIMENTS

This invention is directed to a lightweight magnetic antenna structure or sensor for detecting AC magnetic fields in the extra low frequency to low frequency ranges of the electromagnetic spectrum (10 Hz–500 kHz). The sensor includes a loaded induction coil and is similar to known ferrite-loaded receiving coils; however, rather than utilizing a ferrite rod as the coil loading member, the magnetic flux is now concentrated using a new coil loading material comprising metallic glass, a material manufactured by Metglas Products, Parsippany, N.J. and which is currently identified by the product line called "Metglas Ribbon" and sold under Part No. 2705M.

Figure 1:
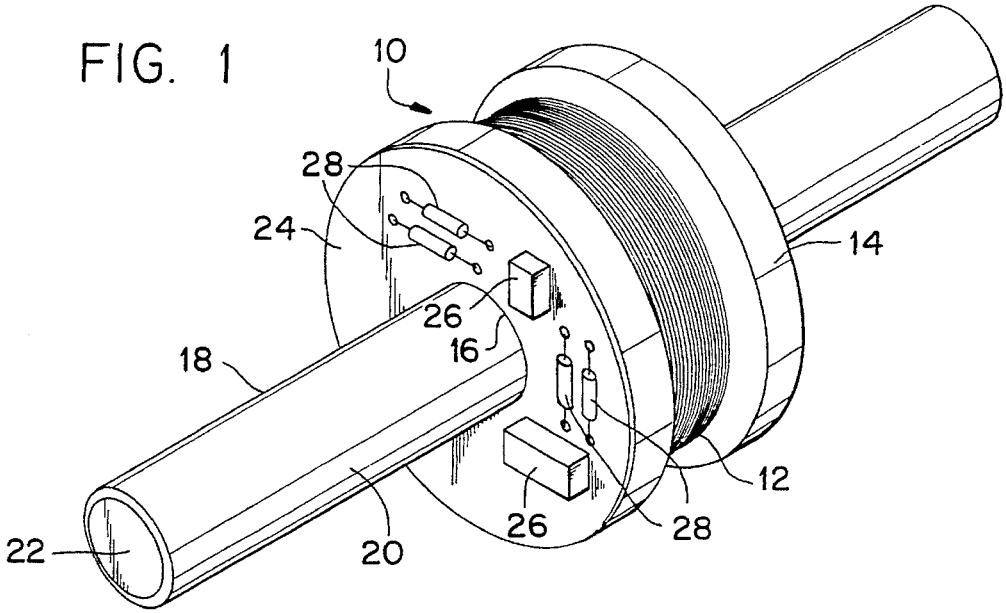
FIG. 1 is a perspective view generally illustrative of one preferred embodiment of the invention.
Figure 2:
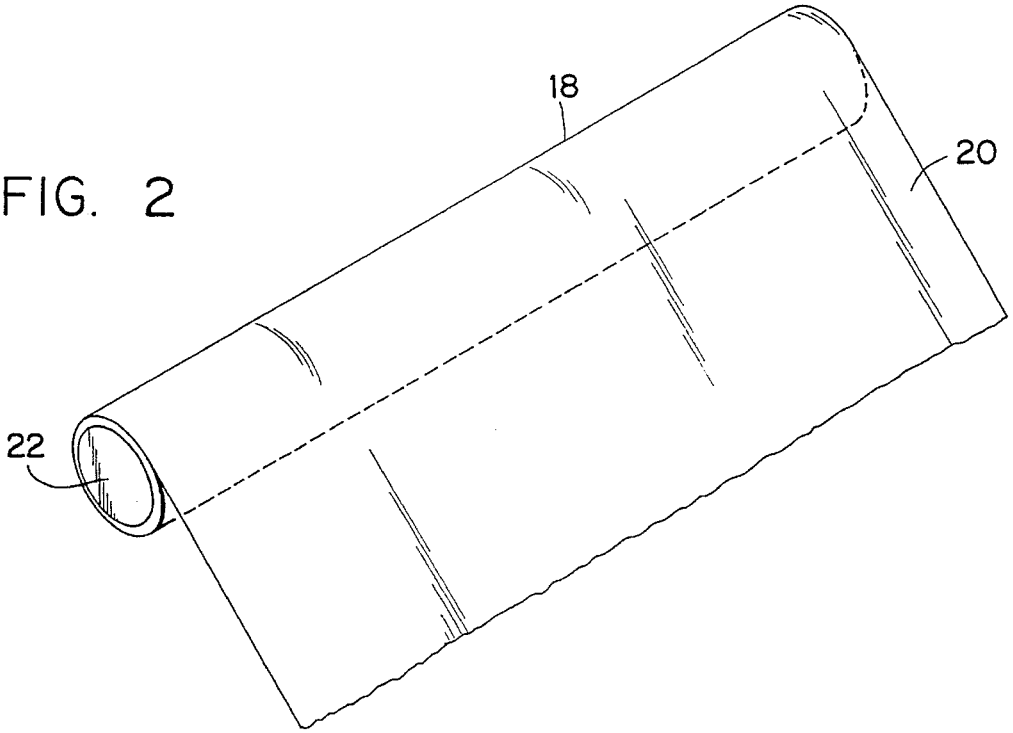
FIG. 2 is a perspective view illustrative of a coil loading member comprised of a metallic glass sheet being wrapped around a dielectric rod.

Referring now to FIG. 1, shown thereat is a search-coil antenna configuration according to a first embodiment of the invention which is comprised of an induction coil 12 consisting of many turns of electrically conductive wire wound on a dielectric coil form 14 which is in the form of a spool of circular cross section and having a central circular aperture or opening 16 through which is inserted an elongated sensor coil loading device 18. The coil loading device 18 is in the form of a relatively long, thin circular cylindrical metallic glass rod comprised of one or more sheets of metallic glass 20, as shown in FIG. 2, wrapped around a lightweight dielectric dowel 22 fabricated from plastic, wood or the like. The loading device 18 has a length which is greater than the width of the spool 14 so that it projects through the circular opening 16 and extends outward from each side thereof a predetermined distance. Typically the width of the induction coil 12 is in the order of 0.4 in., and comprising two thousand turns of wire providing a diameter of 0.875 in. The loading device 18, for example, is at least 6.0 in. long and has a diameter of 0.5 in. A relatively high length to diameter ratio structure is provided thereby.

The use of metallic glass sheets 20 provides a distinct advantage over the known prior art in that the weight of a magnetic antenna using magnetic glass as the coil loading material is substantially reduced. The intrinsic density of "Metglass" is nearly a factor of 2 greater than that of ferrite, for example. However, for a configuration of equal size, only 7% as much material is needed when metallic glass sheets are used. Further, ferrite substances tend to be brittle, shearing under torques and shattering under extreme pressure. With sheets of metallic glass 20 wrapped on a lightweight plastic or wooden dowel 22, this inherent limitation is overcome with the structural integrity limited only by adhesive fastening of the wrap to the dowel. Such a sensor is desirable in many applications, particularly in space flight where space science and communication studies are currently being carried out.

Figure 3:
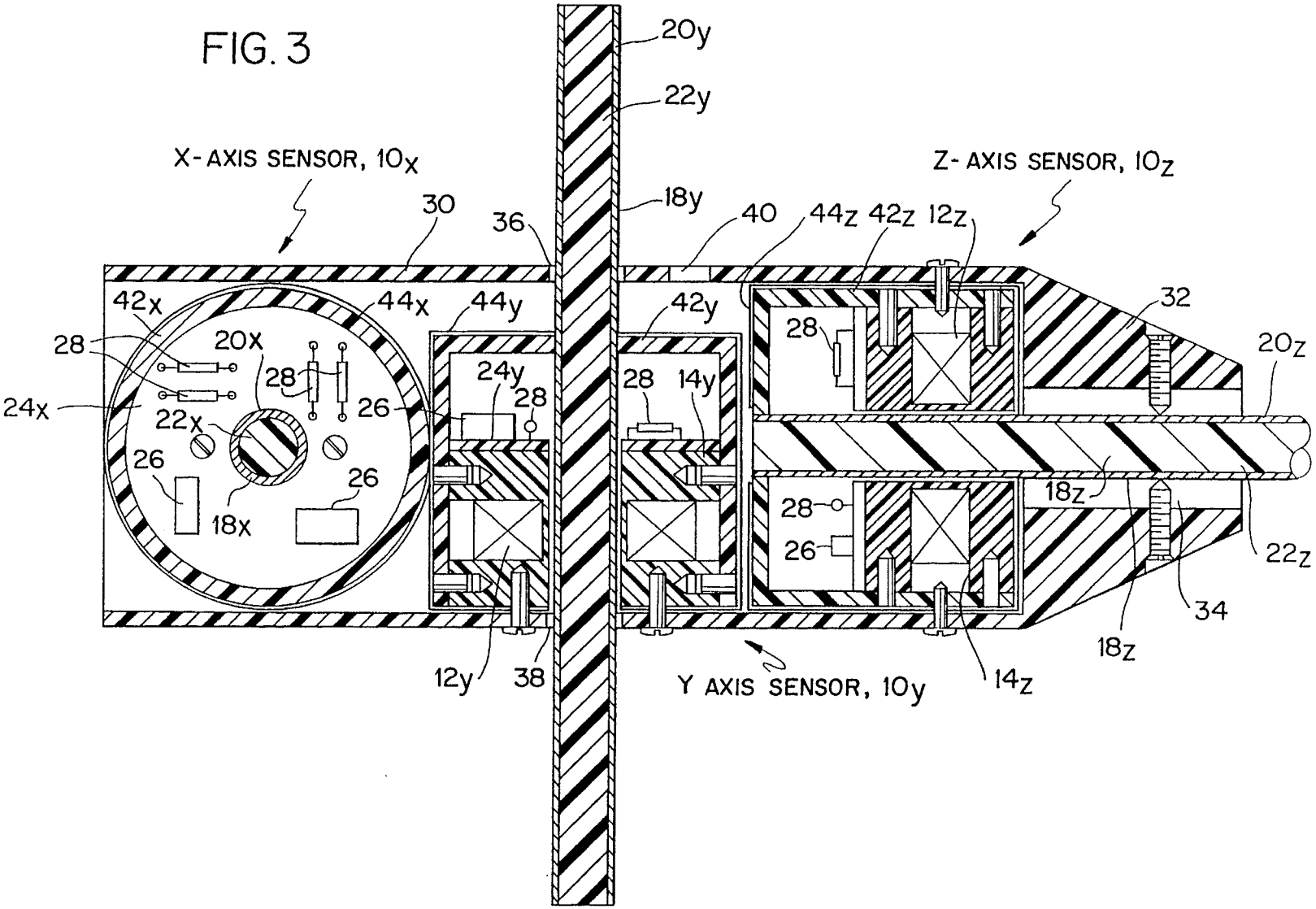
FIG. 3 is a central longitudinal cross sectional view illustrative of a second preferred embodiment of the invention.

Referring now to FIG. 3, shown thereat is a second embodiment of the invention comprised of a tri-axial metallic glass search coil assembly for measuring field strength along three mutually perpendicular X, Y and Z axes (Cartesian coordinates). As shown, the assembly includes three substantially identical magnetic antenna structures $\mathbf{10}_x$, $\mathbf{10}_y$ and $\mathbf{10}_z$, one of which is shown in FIG. 1, oriented in an orthogonal configuration and mounted within a tubular dielectric housing comprising an outer shell 30 including a tapered nose portion 32. The nose portion 32 also includes a central axial bore 34 for the passage of the loading member $\mathbf{18}_z$ therethrough. The outer shell 30 also includes a transverse set of holes 36 and 38 for the passage of the coil loading member $\mathbf{18}_y$ therethrough. An additional opening or hole 40 is also provided in the outer shell 30 for the passage of a wiring harness, not shown, therethrough which is adapted to be connected to the various electrical components 26 and 28 located on circuit wiring boards $\mathbf{24}_x$, $\mathbf{24}_y$ and $\mathbf{24}_z$, respectively attached to coil spools $\mathbf{14}_x$, $\mathbf{14}_y$ and $\mathbf{14}_z$.

It should also be noted that in the tri-axial search-coil assembly shown in FIG. 3, the three search coils $\mathbf{12}_x$, $\mathbf{12}_y$, $\mathbf{12}_z$, their respective mounting spools $\mathbf{14}_x$, $\mathbf{14}_y$ and $\mathbf{14}_z$ and circuit boards $\mathbf{24}_x$, $\mathbf{24}_y$ and $\mathbf{24}_z$ are further located in and fastened to generally circular type dielectric spool enclosure members $\mathbf{42}_x$, $\mathbf{42}_y$ and $\mathbf{42}_z$ which fit inside the outer shell 30. Each of the enclosure members $\mathbf{42}_x$, $\mathbf{42}_y$ and $\mathbf{42}_z$, moreover, are covered with electrical shielding $\mathbf{44}_x$, $\mathbf{44}_y$ and $\mathbf{44}_z$ and which may comprise, for example, metallic foil or other type of electrical shielding material. A grounding wire, not shown, extends from each circuit board $\mathbf{24}_x$, $\mathbf{24}_y$ and $\mathbf{24}_z$ to the electrical shielding $\mathbf{42}_x$, $\mathbf{42}_y$, $\mathbf{42}_z$, respectively.

Each loaded sensor coil $\mathbf{12}_x$, $\mathbf{12}_y$ and $\mathbf{12}_z$ has an intrinsic inductance L, distributed capacitance C and an inherent resistance R. As is well known, the combination of the inductance and capacitance controls the frequency of resonance where the inductive reactance $X_L$ and the capacitive reactance $X_C$ cancel each other, leaving only a resistive impedance $X_R$. At the resonant frequency, the output signal voltage is amplified by a factor Q, often referred to as a resonance quality factor, which is functionally dependent upon the inherent resistive losses. As the resistance losses decrease, Q increases.

Figure 4:
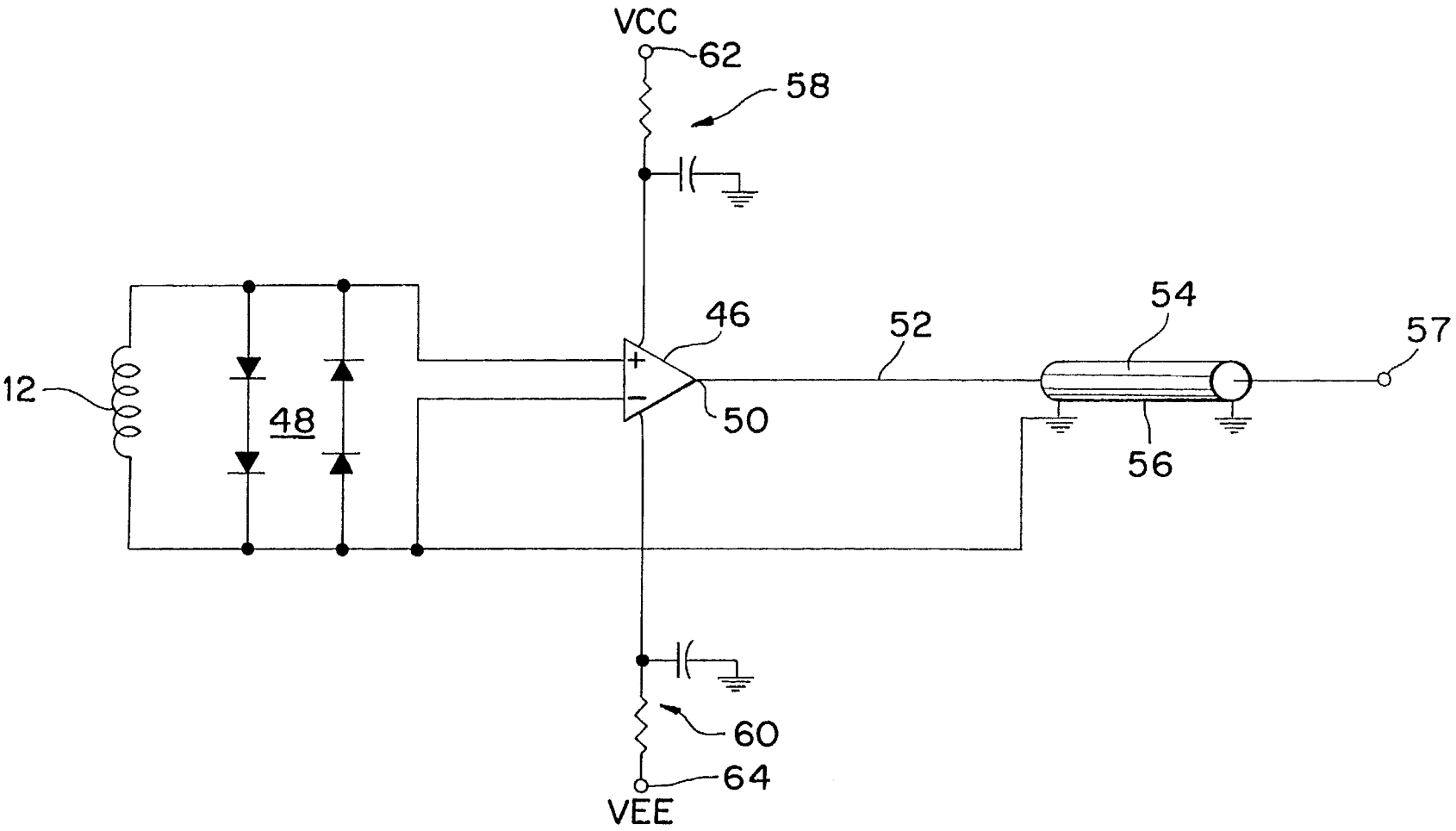
FIG. 4 is an electrical schematic diagram illustrative of a buffer amplification circuit for use in connection with a search-coil shown, for example, in FIG. 1.

Since the characteristics of antenna structures such as shown in FIGS. 1 and 3 are easily altered by any load, a buffer or a preamplifier is normally connected to the ends of the coils 12 in FIG. 1 and the coils $\mathbf{12}_x$, $\mathbf{12}_y$ and $\mathbf{12}_z$ of FIG. 3 to electrically isolate the antenna(s) from subsequent electronic circuitry. FIG. 4 is illustrative of one such amplifier.

Referring now to FIG. 4, shown thereat is an amplifier 46 having its + and − inputs coupled across a search-coil 12. The amplifier 46 typically comprises a Precision Monolithic Inc. AMP-01 instrument amplifier which has high common mode rejection characteristics for enhanced signal to noise performance. A four diode limiting network 48 is also shown coupled across the + and − inputs to the amplifier 46. The amplifier 46, moreover, includes a low impedance output terminal 50 which is shown connected to the inner conductor 52 of a coaxial cable 54 whose outer conductor 56 is shown connected to ground. The output of the amplifier 46 is thus connectable via terminal 57 to subsequent amplifier stages, for example, not shown. Power supply potentials $V_{cc}$ and $V_{ee}$ are applied to the amplifier 46 through respective RC filter networks 58 and 60 via terminals 62 and 64.

Figure 5:
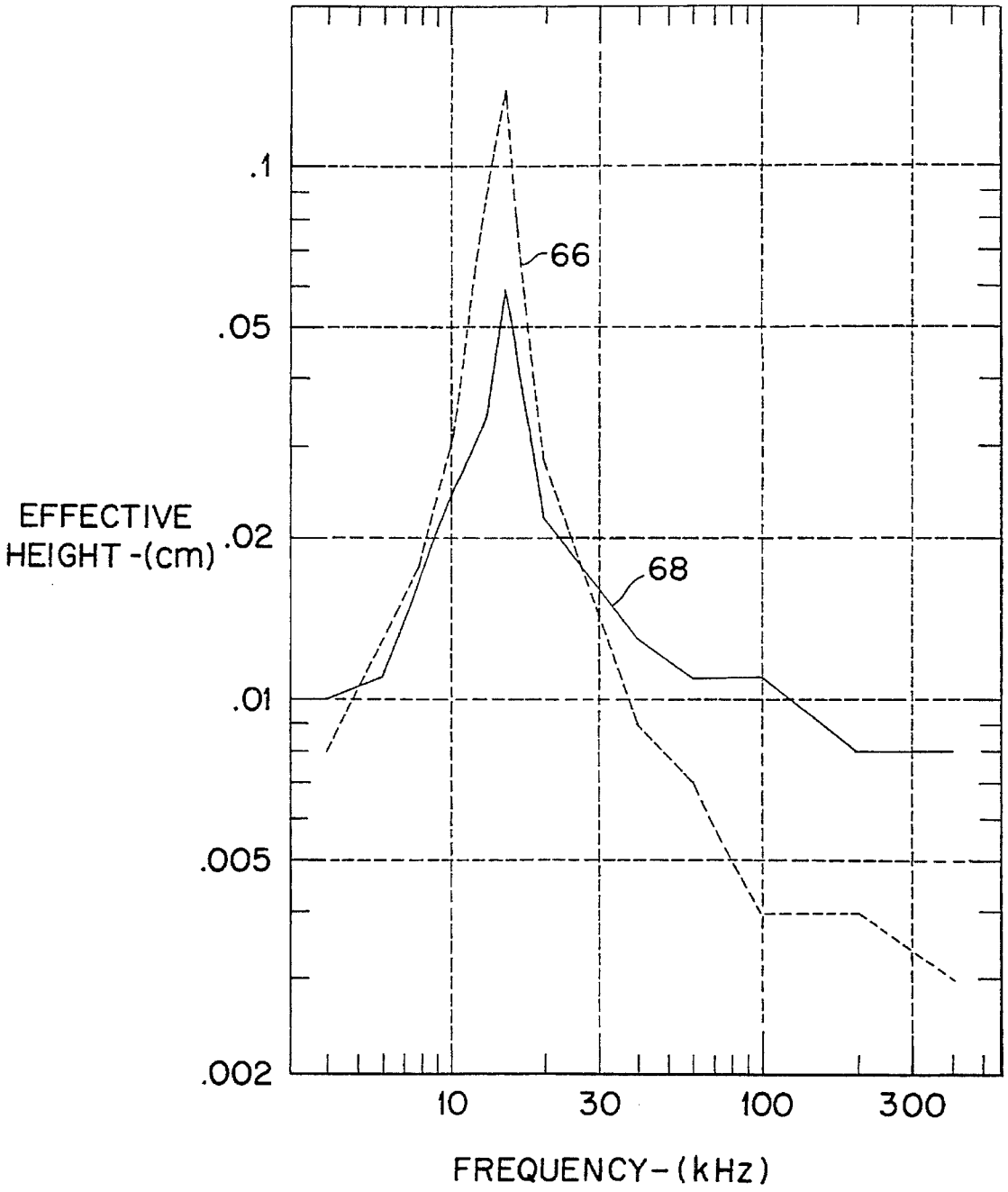
FIG. 5 is a graph illustrative of the effective height vs. frequency characteristic of a search-coil constructed in accordance with the teachings of the subject invention.

Referring now to FIG. 5, shown thereat is a pair of characteristic curves 66 and 68 illustrating the "effective" height as a function of frequency of a magnetic antenna as shown in FIGS. 1 and 3. Curve 66 is illustrative of a ferrite loaded antenna while curve 68 is illustrative of a metallic glass loaded antenna in accordance with the subject invention.

The effective height is defined as the equivalent length of a short electric dipole antenna required to obtain the same output voltage as the magnetic antenna. The effective height h can be defined mathematically as:

$$h=i\omega\mu_{rod}QNA/c$$

where i implies the imaginary portion of a complex number x+iy, $\omega=2\pi f$ where f is the frequency, $\mu_{rod}$ is effective permeability of the material, Q is the RLC quality factor, N is the number of turns of the inductor, A is the cross sectional area of the coil and c is the speed of light. Accordingly, the magnitude of h is a measure of the sensitivity of the magnetic antenna. Thus the sensitivity of a ferrite type sensor as shown by the characteristic curve 66 for a ferrite type antenna is more sensitive in the 10–20 kHz range, while a metallic glass loaded antenna characteristic as shown by reference numeral 68 is more sensitive in the range of frequencies above 30k and which is of particular interest for studies involving space science such as the high latitude polar region of the earth's ionosphere.

Thus what has been shown and described is a metallic glass antenna having low ohmic loss and high magnetic permeability particularly adapted for use in detecting AC magnetic fields associated with VLF wave activity above the earth's surface.

Having thus shown and described what is at present considered to be the preferred embodiments of the invention, it should be known that the same has been made by way of illustration and not limitation. Accordingly, all modifications, alterations and changes coming within the spirit and scope of the invention as set forth in the appended claims are herein meant to be included.

We claim:

1. A lightweight search-coil antenna for detecting magnetic fields, comprising:

a multi-turn electromagnetic induction coil wound on a cylindrically shaped coil form wherein said coil form is of a predetermined width dimension measured along a central axis and includes a spool located in a dielectric enclosure with an elongated loading device extending out of said dielectric enclosure; and said elongated loading device for said coil inserted through the center of said coil, said elongated loading device including a metallic glass material wrapped around a dielectric support member with a thickness dimension and a length dimension wherein said length dimension is relatively larger than said thickness dimension so as to provide a relatively large length to thickness ratio.

2. An antenna according to claim 1 wherein said dielectric support member comprises a dielectric rod and said metallic glass material comprises at least one sheet of metallic glass wrapped around said rod.

3. An antenna according to claim 2 wherein said at least one sheet of metallic glass is wrapped around said rod so as to provide a laminated coil loading structure.

4. An antenna according to claim 1 wherein said loading device has a transverse cross sectional dimension and wherein the ratio of said length dimension to said transverse cross sectional dimension is relatively large.

5. An antenna according to claim 1 and additionally including means located on the spool for mounting electrical circuit components thereon.

6. An antenna according to claim 5 wherein said means for mounting comprises a circuit board.

7. An antenna according to claim 1 wherein said dielectric enclosure includes electrical shielding located on the outside thereof.

8. An antenna according to claim 1 and additionally including a dielectric outer shell for supporting said enclosure and said spool with said induction coil wound thereon.

9. A tri-axial search-coil antenna structure, comprising:

a housing;

three mutually orthogonal electromagnetic induction coil sensor assemblies located in said housing;

each of said sensor assemblies including a coil wound on a coil form, and a coil loading device projecting through said coil and comprising an elongated dielectric cylindrical support member having at least one layer of metallic glass wound thereon.

10. An antenna structure according to claim 9 wherein said layer of metallic glass comprises at least one sheet of metallic glass wrapped around said support member in a plurality of turns so as to provide a plurality of layers of metallic glass.

11. An antenna structure according to claim 9 wherein each said dielectric support member is cylindrical in cross-section.

12. An antenna structure according to claim 9 wherein said dielectric support member has a thickness dimension and a length dimension for providing a relatively large length to thickness ratio.

13. An antenna structure according to claim 9 wherein said coil form comprises a dielectric spool type member.

14. An antenna structure according to claim 13 wherein said coil and spool type member are located in a dielectric enclosure.

15. An antenna structure according to claim 14 wherein said housing comprises a dielectric outer shell for supporting said coil sensor assemblies.

16. An antenna structure according to claim 14 wherein said outer shell comprises a circular cylindrical housing member.

17. An antenna structure according to claim 16 wherein said housing member includes a tapered nose portion at one end thereof.

* * * * *